US011382377B2

(12) United States Patent
Venkata Jagannadha Rao

(10) Patent No.: US 11,382,377 B2
(45) Date of Patent: Jul. 12, 2022

(54) HELMET SYSTEMS AND METHODS FOR DETECTION AND NOTIFICATION OF OBJECTS PRESENT IN THE BLIND SPOT

(71) Applicant: Anirudha Surabhi Venkata Jagannadha Rao, Secunderabad (IN)

(72) Inventor: Anirudha Surabhi Venkata Jagannadha Rao, Secunderabad (IN)

(73) Assignee: Anirudha Surabhi Venkata Jagnnadha Rao, Secunderabad (IN)

( * ) Notice: Subject to any disclaimer, the term of this patent is extended or adjusted under 35 U.S.C. 154(b) by 299 days.

(21) Appl. No.: 16/492,154

(22) PCT Filed: Mar. 10, 2018

(86) PCT No.: PCT/IB2018/051588
§ 371 (c)(1),
(2) Date: Sep. 9, 2019

(87) PCT Pub. No.: WO2018/167625
PCT Pub. Date: Sep. 20, 2018

(65) Prior Publication Data

US 2021/0137199 A1 May 13, 2021

(30) Foreign Application Priority Data

Mar. 11, 2017 (IN) ..... 201741004964

(51) Int. Cl.
*A42B 3/30* (2006.01)
*A42B 3/04* (2006.01)
*A42B 3/08* (2006.01)

(52) U.S. Cl.
CPC ..... *A42B 3/046* (2013.01); *A42B 3/044* (2013.01); *A42B 3/0466* (2013.01); *A42B 3/08* (2013.01); *A42B 3/30* (2013.01)

(58) Field of Classification Search
CPC ..... A42B 3/30; A42B 3/0453; A42B 1/24; A42B 3/04
See application file for complete search history.

(56) References Cited

U.S. PATENT DOCUMENTS 8,161,570 B2 * 4/2012 McVeigh ..... A63B 69/0002 2/24
2018/0000184 A1 * 1/2018 Jang ..... F21V 33/0008
(Continued)

*Primary Examiner* — Tajash D Patel
(74) *Attorney, Agent, or Firm* — Anirudha Surabhi Venkata Jagnnadha Rao

(57) ABSTRACT

Exemplary embodiments of the present disclosure are directed towards helmet systems and methods for detection and notification of objects present in the blind spot. They detect objects through ultrasonic sensors and notify the presence of those objects through sensory output modules such as LED output modules, vibration motors and speakers. The helmet system comprises of at least one helmet body, at least two ultrasonic sensors positioned at the left and right side of at least one helmet body to cover a blind spot on the left and right side of a user, at least two LED output modules positioned at the right and left side of the front of at least one helmet body. at least two vibration motors which are concealed on either side of the helmet body and at least two vibration motors configured to generate the different patterns of an haptic feedback based on the different signals generated by at least two ultrasonic sensors. At least two speakers are positioned at the right and left side of at least one helmet body and at least two speakers are configured to give an audio feedback. And at least one processing device electrically coupled to at least two ultrasonic sensors, and at least two LED output modules, at least two vibration motors and at least two speakers. At least two ultrasonic sensors are configured to detect objects in the blind spot region and at least one LED output module and at least one vibration motor and at least one speaker configured notify the presence of the objects.

7 Claims, 5 Drawing Sheets

(56) References Cited

U.S. PATENT DOCUMENTS

| | | | | |
|---|---|---|---|---|
| 2018/0014597 | A1* | 1/2018 | Cooke | H04R 1/028 |
| 2020/0128902 | A1* | 4/2020 | Brown | A42B 3/30 |

* cited by examiner

HELMET SYSTEMS AND METHODS FOR DETECTION AND NOTIFICATION OF OBJECTS PRESENT IN THE BLIND SPOT

TECHNICAL FIELD

The present disclosure generally relates to the field of helmet systems. More particularly, the present disclosure relates to helmet systems for detection and notification of objects present in the blind spot and methods thereof.

BACKGROUND

Helmets are meant to safeguard two-wheeler riders but user habits compromise the safety of helmets. The unsafe practices include non-wearing of helmets, non-strapping of helmets, using worn out helmets, using mobile phones while riding, turning of the user's head to check for vehicles at blind spot (i.e. field of view not covered by their eyes or rear-view mirrors) etc. There are currently many intelligent helmet systems that address one or many of these issues.

There are independent Communication modules available in market that can be attached to the helmets for using devices like mobile phones while riding. But they leave loose wires hanging around the helmet making them inconvenient and non-aesthetic. The helmet systems with integrated Communication modules that are currently available are exorbitantly priced.

There are helmet systems that use cameras and image processing techniques to visualise objects present in the blind spots of users (eg: Skully helmets). However, these helmets involve a lot of processing due to use of image processing cameras and hence are bulkier and costlier. Also these helmets (Skully) have display screens in the visors, which might distract the driver from driving and can be intrusive and unsafe.

In the light of aforementioned discussion, there exists a need for cost-effective helmet systems that enhance the safety and convenience of commuters. The present invention discloses helmet systems that detect objects present in the blind spot through ultrasonic sensors and notify their presence through sensory output modules and methods thereof. The use of ultrasonic sensors involves less processing, low cost and simple circuitry and the use of sensory output modules such as, LED output modules, vibration motors, and speakers makes the system non-intrusive and safe. The present invention further discloses helmet systems with their strapping means acting as power switches wherein the power is switched on for operating the helmet system by strapping the helmet. This ensures that the commuters strap their helmet on while riding. In some embodiments, the strapping means of the helmet systems utilise novel self-locking round screw buckle units comprising male and female parts that are releasably engaged with each other by magnetic means and a threaded engagement. In some embodiments, the helmet systems disclosed herein are integrated with blue-tooth modules connecting the helmet system with devices such as mobile phones and thus allowing the riders to use the different functionalities of their devices without having to remove their helmets every time.

BRIEF SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

Exemplary embodiments of the present disclosure are directed towards helmet systems and methods that detect and notify the presence of objects in the blind spot. They detect objects through ultrasonic sensors and notify the presence of those objects through sensory output modules. In a particular embodiment, the sensory output module is a LED output module, vibration motors, and speakers. The helmet system comprises of a helmet, strapping means, a processing device, one or more of ultrasonic sensors, one or more of sensory output modules and a power means. In a particular embodiment, the power means comprises of rechargeable batteries and a battery charging circuit. The strapping means comprise of a strap and buckle unit with inbuilt power connectors and as the buckle is fastened, the helmet's circuit gets closed and the helmet system starts working. This feature works as an additional safety feature to force the user to fasten the helmet's buckle. In a particular embodiment the helmet system further comprises of a communication module, speakers and microphones.

Another exemplary embodiment of the present subject matter is directed towards a method of a helmet system. As soon as the driver wears the helmet and fastens the strapping means, the entire circuit concealed inside the helmet gets connected and the system becomes operational. The left and right ultrasonic sensors (transceivers) emit sound waves continuously which on collision with any vehicle return back to the respective transceiver. The transceiver sends the received data to the processing device, where the processing device processes and compares the data as per the programming and makes a decision if any object or vehicle is present in the blind spot or not. If any object is detected, the processing device sends the signal to the corresponding sensory output module. For example, in a LED output module, the corresponding LED i.e. left or right glows indicating the presence of a vehicle in the blind spot. For another example, in vibration motors, the corresponding vibration motor generate the haptic feedback i.e. left or right notify the presence of the vehicle in the blind spot. For another example, in speakers, the corresponding speaker generate an audio feedback i.e., left or right notify the presence of the vehicle in the blind spot. In a particular embodiment, the method also includes the step of activating the communication module after connecting the power circuit to make the system operational thus enabling the user to use their electronic devices.

Another exemplary embodiment of the present subject matter is directed towards a side release buckle unit. It comprises of a male part attached to a strap and a female part attached to another strap. The female part houses two wires on either side of a base. One side of the base houses the first wire from the battery and the other side of the base houses the second wire connecting the entire circuit of the helmet system. The first wire and the second wire are insert molded inside the female part and have contact surfaces. The male part has a conducting plate on its middle pin's tip. When the female part is clamped to the male part, the conducting plate on the male part acts as a bridge (switch) and connects both the contact surfaces of the female part. This way the circuit gets completed and helmet's system becomes operational.

Another exemplary embodiment of the present subject matter is directed towards a self-locking round screw buckle unit. This buckle unit comprises of a male part and a female part that are attached to different straps of the helmet body.

The male part comprises of a rotatable base attached to a strap, a main body having a round screw with an external thread and a conducting first magnet. The female part comprises of a base attached to another strap, a main body having a cavity with an internal thread, a pair of conducting second magnets and two conducting wires. The two conducting wires are on either side of the base. One side of the base houses the first wire from the battery and the other side of the base houses the second wire connecting the entire circuit of the helmet system. The first wire and the second wire are insert molded inside the female part and have contact surfaces. The first wire is attached through its contact surface to one of the second magnet and the second wire is attached through its contact surface to the other second magnet. The external thread of the male part and the internal thread of the female part correspond to each other and are configured to engage with each other. The magnets and the threaded engagement of the male and female parts are configured to releasably engage the male and female parts of the buckle.

Another exemplary embodiment of the present subject matter is directed towards the helmet system comprising at least one helmet body, at least two ultrasonic sensors positioned at the left and right side of at least one helmet body to cover a blind spot on the left and right side of a user.

Another exemplary embodiment of the present subject matter is directed towards the helmet system further comprising at least two LED output modules positioned at the right and left side of the front of at least one helmet body.

Another exemplary embodiment of the present subject matter is directed towards the helmet system further comprising at least two vibration motors which are concealed on either side of the helmet body and at least two vibration motors configured to generate the different patterns of a haptic feedback based on the different signals generated by at least two ultrasonic sensors.

Another exemplary embodiment of the present subject matter is directed towards the helmet system further comprising at least two speakers are positioned at the right and left side of at least one helmet body and at least two speakers are configured to give an audio feedback.

Another exemplary embodiment of the present subject matter is directed towards the helmet system further comprising at least one processing device electrically coupled to at least two ultrasonic sensors and at least two LED output modules and at least two vibration motors and at least two speakers, whereby at least two ultrasonic sensors configured to detect objects in the blind spot region and at least one LED output module and at least one vibration motor and at least one at least one speaker configured to notify the presence of the objects.

It is an object of the present invention to disclose helmet systems for detection and notification of objects present in the blind spot that enhance the safety and convenience of the users.

BRIEF DESCRIPTION OF DRAWINGS

Other objects and advantages of the present invention will become apparent to those skilled in the art upon reading the following detailed description of the preferred embodiments, in conjunction with the accompanying drawings, wherein like reference numerals have been used to designate like elements, and wherein:

FIG. 6 (*b*) is a diagrammatic representation showing the region covered by the helmet system in accordance with a non-limiting exemplary embodiment of the present disclosure.

DETAILED DESCRIPTION

Figure 1:
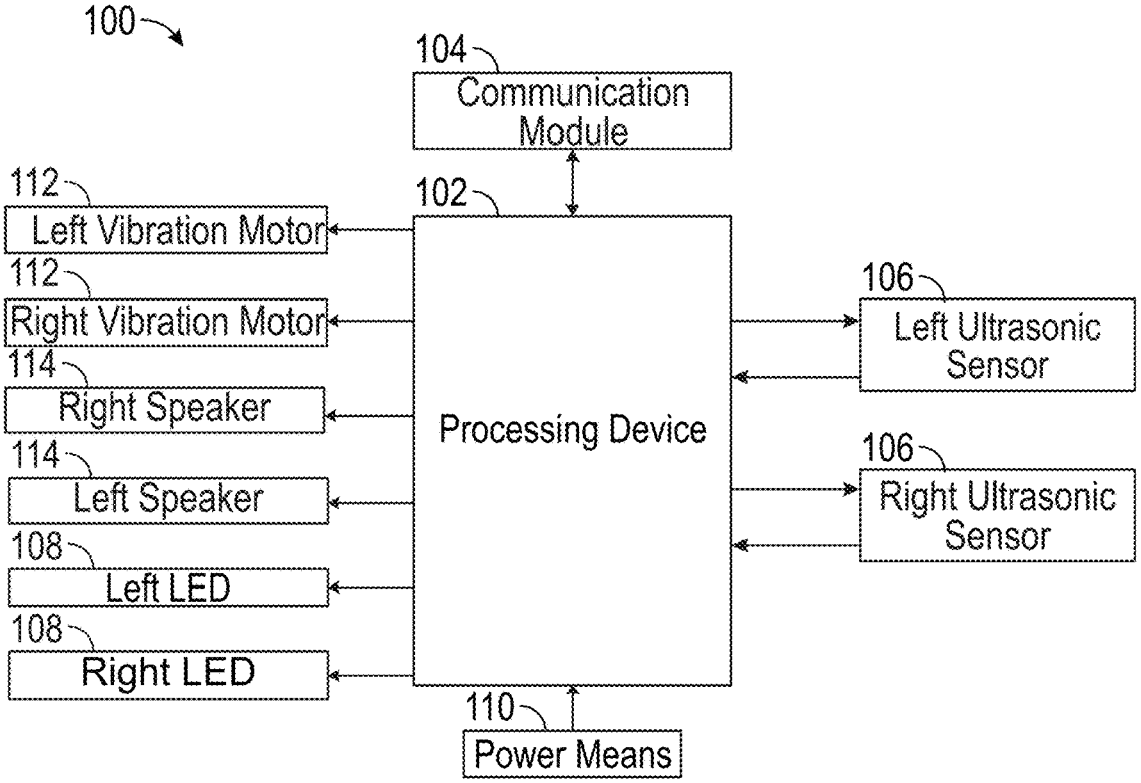
FIG. 1 represents a functional block diagram 100 of the helmet system, in accordance with a non-limiting exemplary embodiment of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting.

The use of "including", "comprising" or "having" and variations thereof herein is meant to encompass the items listed thereafter and equivalents thereof as well as additional items. The terms "a" and "an" herein do not denote a limitation of quantity, but rather denote the presence of at least one of the referenced item. Further, the use of terms "first", "second", and "third", and the like, herein do not denote any order, quantity, or importance, but rather are used to distinguish one element from another.

According to various non limiting exemplary embodiments of the present disclosure, helmet systems and methods that detect and notify the presence of objects in the blind spot are disclosed. They detect objects through ultrasonic sensors and notify the presence of those objects through sensory output modules. The sensory output modules could be visual, auditory, tactile or any other sensory output modules that are known in the art without limiting the scope of the present disclosure. In a particular embodiment, the sensory output module is a LED output module. These helmet systems and methods are suitable for two wheelers such as motorbikes and bikes.

In accordance with various non limiting exemplary embodiments of the present subject matter, helmet systems and methods are disclosed that have their strapping means acting as power switches. Here, the power is switched on for operating the helmet systems by strapping the helmet.

According to various non limiting exemplary embodiments of the present disclosure, novel strapping means and methods for using the strapping means are disclosed. These strapping means utilise novel self-locking round screw buckle units comprising male and female parts that are releasably engaged with each other by magnetic means and a threaded engagement.

In accordance with various non limiting exemplary embodiments of the present subject matter, helmet systems and methods are disclosed wherein the helmet systems are integrated with blue-tooth modules connecting the helmet system with devices such as mobile phones and thus allowing the riders to use the different functionalities of their devices without having to remove their helmets every time.

According to a non-limiting exemplary embodiment of the present disclosure, the helmet system detects incoming objects or vehicles in the driver's blind spot region and alerts the driver about the same with visual cues. The ultrasonic sensors in the system detect objects in the blind spot region. This data is processed by a processing device to give output with the help of LEDs, which are fixed in the front of the helmet.

In a particular embodiment, the helmet system comprises of a helmet, strapping means, a processing device, one or more of ultrasonic sensors, one or more of LED output modules and a power means. In a particular embodiment, the power means comprises of rechargeable batteries and a battery charging circuit. The rechargeable batteries are charged using adapters. In a particular embodiment, the rechargeable batteries are lithium ion rechargeable batteries. The strapping means comprise of a strap and buckle unit with inbuilt power connectors and as the buckle is fastened, the helmet's circuit gets closed and the helmet system starts working. This feature works as an additional safety feature to force the user to fasten the helmet's buckle.

In a particular embodiment the helmet system further comprises of a communication module, speakers and microphones. The communication module can be either integrated within the processing device or can be a separate module. It lets the user connect his/her device such as mobile phone to the helmet and use it for receiving or making calls and other auditory purposes like listening to music.

Referring to FIG. 1, it represents a functional block diagram 100 of the helmet system, in accordance with a non-limiting exemplary embodiment of the present disclosure. It depicts a processing device 102, an independent communication module 104, two ultrasonic sensors 106, two LED output modules 108 a power means 110, two vibration motors 112, and two speakers 114. The processing device 102 electrically coupled to the ultrasonic sensors 106, the LED output modules 108, the vibration motors 112 and the speakers 114. The processing device 102 includes but is not limited to, a microcontroller (for example ARM 7 or ARM 11), a microprocessor, a digital signal processor, a microcomputer, a field programmable gate array, a programmable logic device, a state machine or a logic circuitry. The ultrasonic sensors 106 are configured to detect objects in the blind spot region and at least one LED output module 108 configured to glow and notify the presence of the objects. The communication module 108 includes, but is not limited to a Bluetooth module, a near field communications (NFC) functional module, a radio frequency identification (RFID) module. The communication module 108 is configured to establish communication with an end user device. The end user device includes but is not limited to, a computing device, a smart phone, a wrist watch, a speaker, a microphone, and the like.

Figure 2:
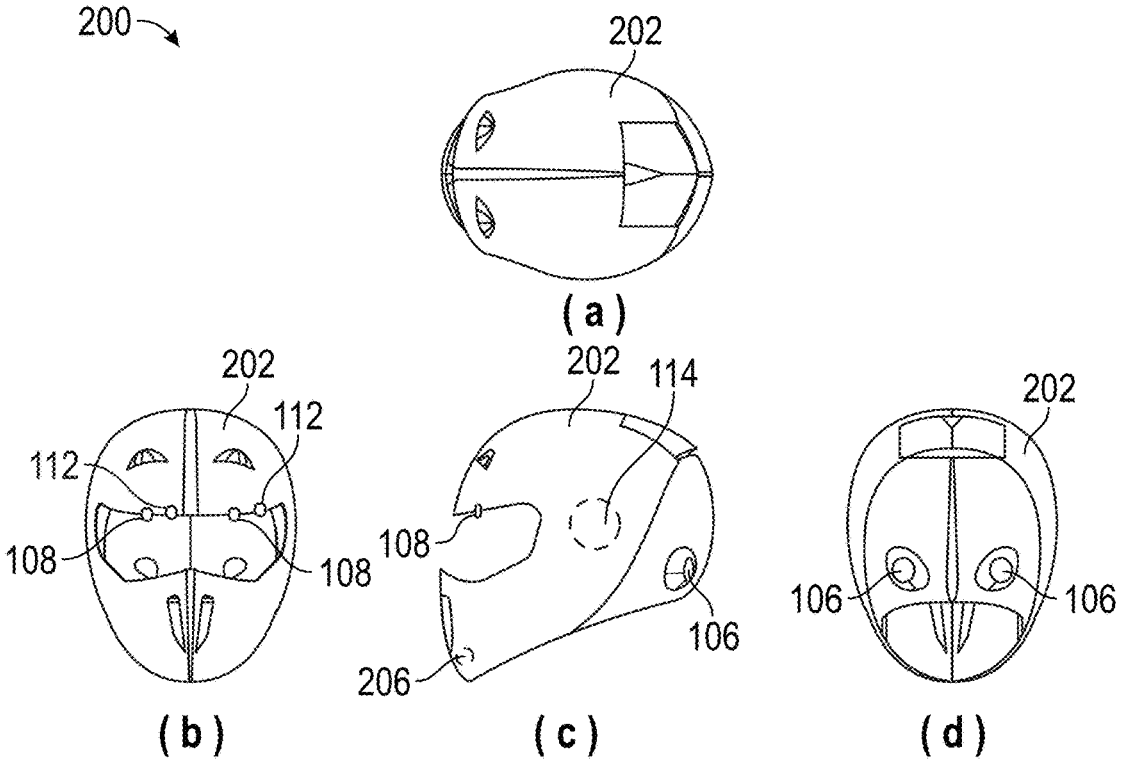
FIG. 2 shows the diagrammatic representation of the top view (a), front view (b), side view (c) and rear view (d) of the helmet system 200, in accordance with a non-limiting exemplary embodiment of the present disclosure.

Referring to FIG. 2, it shows the diagrammatic representation of the top view (a), front view (b), side view (c) and rear view (d) of the helmet system 200, in accordance with a non-limiting exemplary embodiment of the present disclosure. The two ultrasonic sensors 106 are positioned at the left and right side of the helmet body 202 to cover the blind spot on the left and right side of the user. The same way the LED output modules 108 are positioned at the right and left side of the front of the helmet body 202. The vibration motors 112 are positioned at the right and left side of the front of the helmet body. The vibration motors 112 may be concealed on either side of the padding or interior shell of the helmet body 202. Depending on which side the objects are detected by the ultrasonic sensors 106, the corresponding LED output module would glow and notify the presence of the objects. The ultrasonic sensors 106 are configured to transmit the detected data to the processing device 102. A feedback may be given through the LED output modules 108. The vibration motors 112 are configured to notify the presence of the objects. The vibration motors 112 are configured to generate the different patterns of the haptic feedback based on the different signals generated by the ultrasonic sensors 106. The different patterns of the haptic feedback are received by the processing device 102. The haptic feedback in the form of tactile feedback by applying forces, vibrations, or motions from the vibration motors 112 to the user. The figure further depicts the presence of the left speaker 114 and a microphone 206. The left speaker 114 and the right speaker 114 (not shown) are configured to generate an audio feedback to notify the presence of the object in the blind spot.

The helmet body has a hard outer layer and an inner foam layer. In a particular embodiment, the processing device, blue-tooth module, batteries and wires are concealed inside the surface of the helmet in between the hard outer layer and the inner foam layer.

In accordance with a non-limiting exemplary embodiment of the present subject matter, a method of a helmet system is disclosed. As soon as the driver wears the helmet and fastens the strapping means, the entire circuit concealed inside the helmet gets connected and the system becomes operational. The left and right ultrasonic sensors (transceivers) emit sound waves continuously which on collision with any vehicle return back to the respective transceiver. The transceiver sends the received data to the processing device, where the processing device processes and compares the data as per the programming and makes a decision if any object or vehicle is present in the blind spot or not. If any object is detected, the processing device sends the signal to the corresponding sensory output module such as LED. To show the output, the corresponding LED i.e. left or right glows indicating the presence of a vehicle in the blind spot.

In a particular embodiment, the method also includes the step of activating the communication module after connecting the power circuit to make the system operational thus enabling the user to use their electronic devices. In a particular embodiment, the electronic device is a mobile phone and the user can make or respond to calls using the Communication module, microphone and speaker.

To encourage drivers to tie the helmet strap around their chins, the helmet is provided with an extra safety feature, i.e. the helmet's systems will get activated only when the strap of the helmet is tied around by closing the buckle that basically acts as a switch. The strap contains a pair of connecting wires concealed inside it which is connected to the female part of the buckle, which in turn have conducting wires molded inside them. The male part of the buckle contains a conducting contact surface. When the buckle is closed the male part's conducting surface gets in contact with the female part's twin conducting surfaces thus completing the circuit and starting the system.

According to a non-limiting exemplary embodiment of the present disclosure, the buckle unit of the strapping means in the helmet system is like a regular side release buckle with extra components that enables it to perform the function of a switch also other than the regular function of fastening the two straps together.

Figure 3:
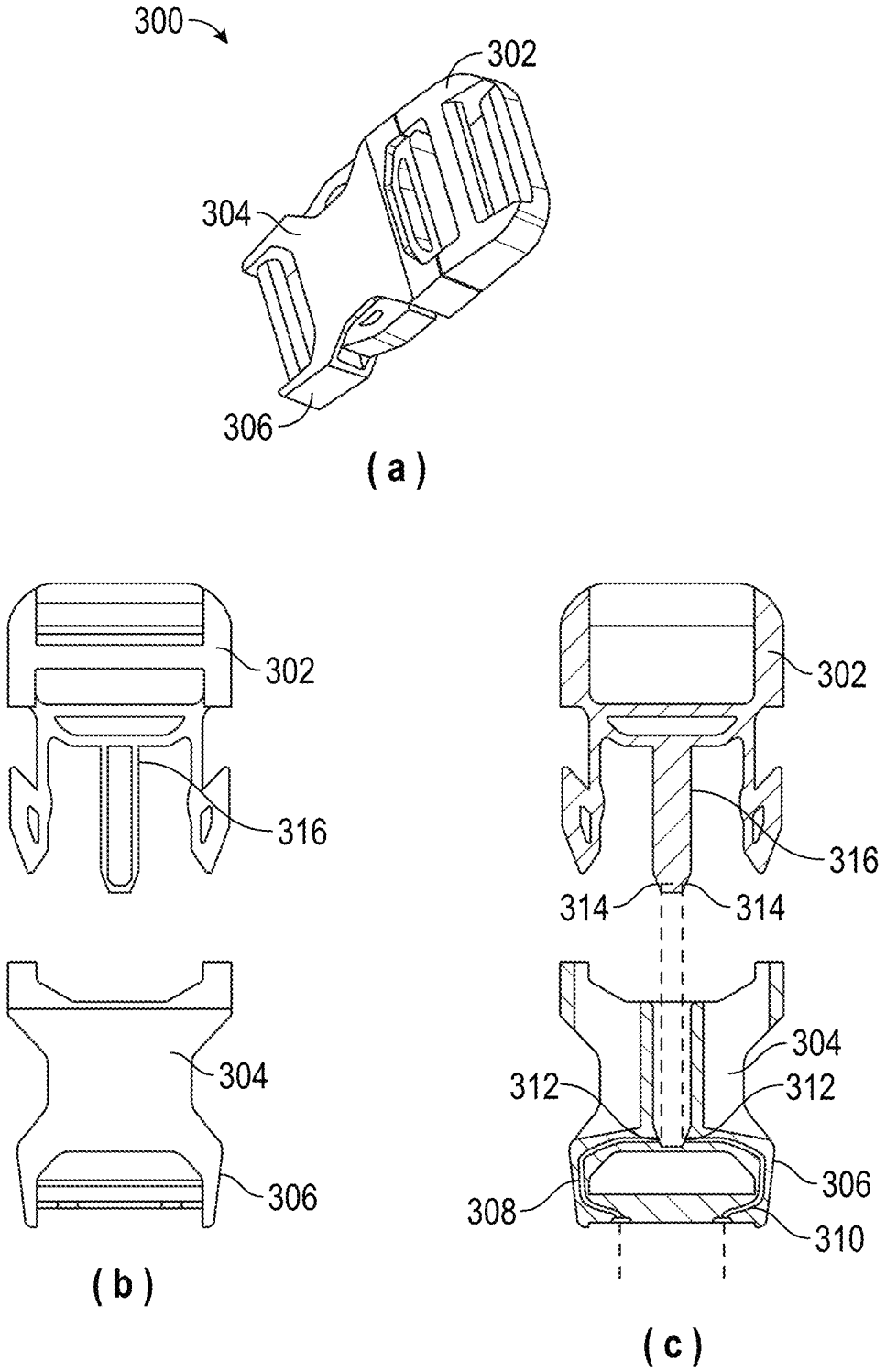
FIG. 3 represents different views of the side release buckle 300, in accordance with a non-limiting exemplary embodiment of the present disclosure. (a) A perspective view of the buckle with the male and female parts engaged with each other. (b) A top view of the buckle with the male and female parts disengaged from each other. (c) A sectional top view of the buckle with the male and female parts disengaged from each other.

Referring to FIG. 3, it represents different views of the side release buckle 300, in accordance with a non-limiting exemplary embodiment of the present disclosure. (a) A perspective view of the buckle with the male and female parts engaged with each other (b) A top view of the buckle with the male and female parts disengaged from each other (c) A sectional top view of the buckle with the male and female parts disengaged from each other. The buckle unit comprises of a male part 302 attached to a strap and a female part 304 attached to another strap. The female part 304 houses two wires on either side of a base 306. One side of the base 306 houses the first wire 308 from the battery and the other side of the base 306 houses the second wire 310 connecting the entire circuit of the helmet system. The first wire 308 and the second wire 310 are insert molded inside the female part 304 and have contact surfaces 312. The first wire 308 and the second wire 310 from the base 306 of the female part 304 pass through the strap attached to the female part 304 into the helmet body. The male part 302 has a conducting plate 314 on its middle pin's 316 tip. When the female part 304 is clamped to the male part 302, the conducting plate 314 on the male part 302 acts as a bridge (switch) and connects both the contact surfaces 312 of the female part. This way the circuit gets completed and helmet's system becomes operational.

The first wire 308 from the power means 110 and the second wire 310 from the processing device 102 are insert molded inside the female part 304 and the first wire 308 from the female part 304 pass through the strap attached to the female part 304 into the helmet body 202.

According to another non limiting exemplary embodiment of the present disclosure, the buckle unit of the strapping means in the helmet system is a self-locking round screw buckle unit comprising male and female parts that are releasably engaged with each other by magnetic means and a threaded engagement.

Figure 4:
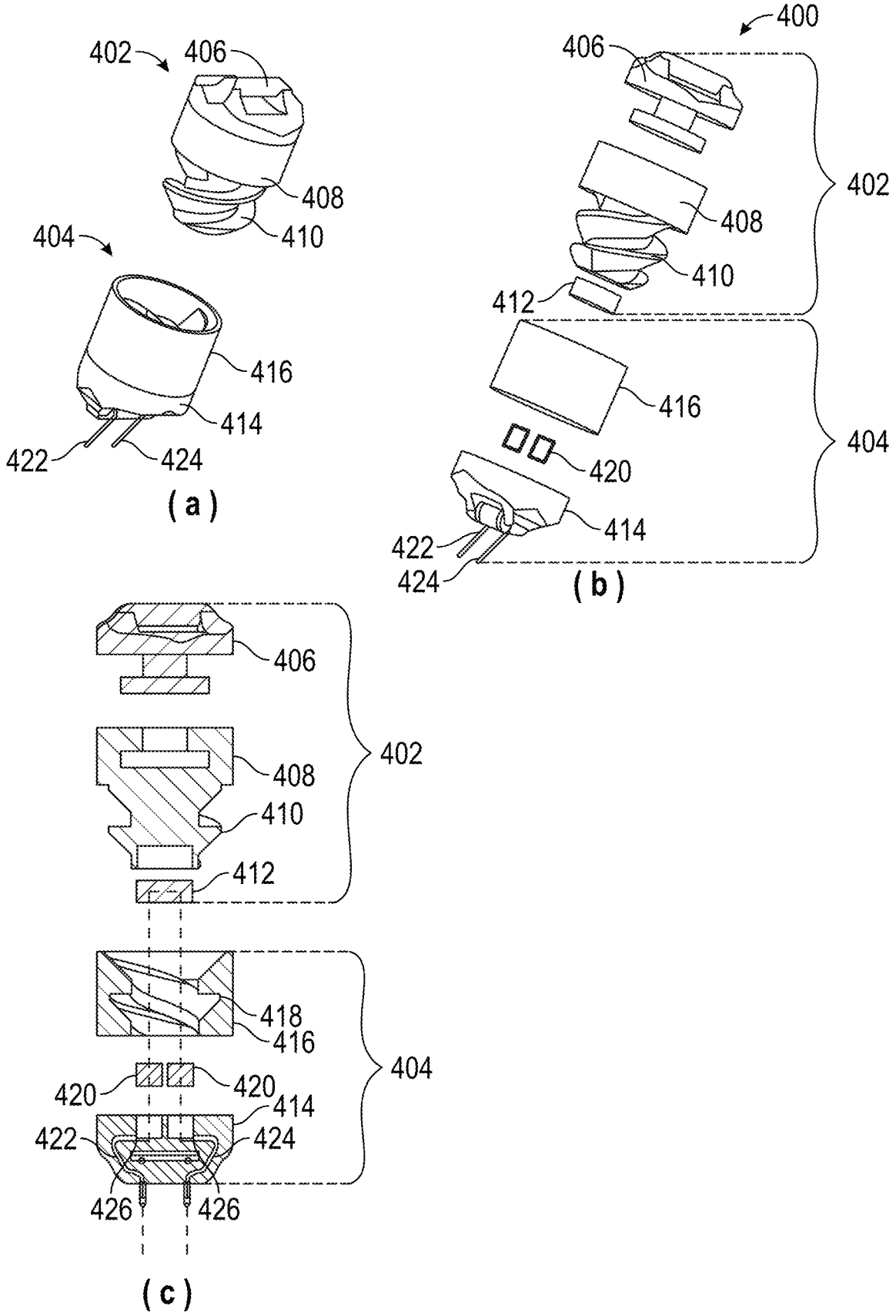
FIG. 4 represents different views of the self-locking round screw buckle unit 400, in accordance with a non-limiting exemplary embodiment of the present disclosure. (a) A perspective view of the buckle with the male and female parts disengaged from each other. (b) An exploded view of the male and female parts of the buckle. (c) A sectional and exploded front view of the male and female parts of the buckle.

Referring to FIG. 4, it represents different views of the self-locking round screw buckle unit 400, in accordance with a non-limiting exemplary embodiment of the present disclosure. (a) A perspective view of the buckle with the male and female parts disengaged from each other. (b) An exploded view of the male and female parts of the buckle. (c) A sectional and exploded front view of male and female parts of the buckle. This buckle unit comprises of a male part 402 and a female part 404 that are attached to different straps of the helmet body. The male part 402 comprises of a rotatable base 406 attached to a strap, a main body 408 having a round screw with an external thread 410 and a conducting first magnet 412. The female part 404 comprises of a base 414 attached to another strap, a main body 416 having a cavity with an internal thread 418, a pair of conducting second magnets 420 and two conducting wires. The two conducting wires are on either side of the base 414. One side of the base 414 houses the first wire 422 from the battery and the other side of the base 414 houses the second wire 424 connecting the entire circuit of the helmet system. The first wire 422 and the second wire 424 are insert molded inside the female part 404 and have contact surfaces 426. The first wire 422 is attached through its contact surface 426 to one of the second magnet 420 and the second wire 424 is attached through its contact surface 426 to the other second magnet 420. The first wire 422 and the second wire 424 from the base 414 of the female part 404 pass through the strap attached to the female part 404 into the helmet body. The external thread 410 of the male part 402 and the internal thread 418 of the female part 404 correspond to each other and are configured to engage with each other. The magnets and the threaded engagement of the male and female parts are configured to releasably engage the male and female parts of the buckle. The female part 404 of the self-locking round screw buckle unit 400 is fixed while the male part 402 is rotatable by means of the rotatable base 406. The rotatable base 406 prevents the twisting of the strap while fastening the strap. The attraction force between the conducting first magnet 412 in the male part 402 and the pair of conducting second magnets 420 present in the female part 404 (opposite poles) clamps them together. The pair of conducting second magnets 420 in the female part 404 have similar cross section as the electrically conducting first magnet 412 in the male part 402 and faces the opposite pole of that male counterpart. The pair of conducting second magnets 420 is positioned side by side with some gap (interference) between them. When the male part 402 comes in contact with the female part 404 because of magnetic force they get attracted towards each other and get clamped by use of threads. And because of threads it is difficult to separate them laterally. The buckle unit works like the nut and bolt mechanism. Magnet is used for pulling force. When both parts are connected then the first magnet 412 in the male part 402 works as the bridge (switch) and connects the pair of second magnets 420 of the female part 404. This way the circuit gets completed and the helmet system becomes operational.

Figure 5:
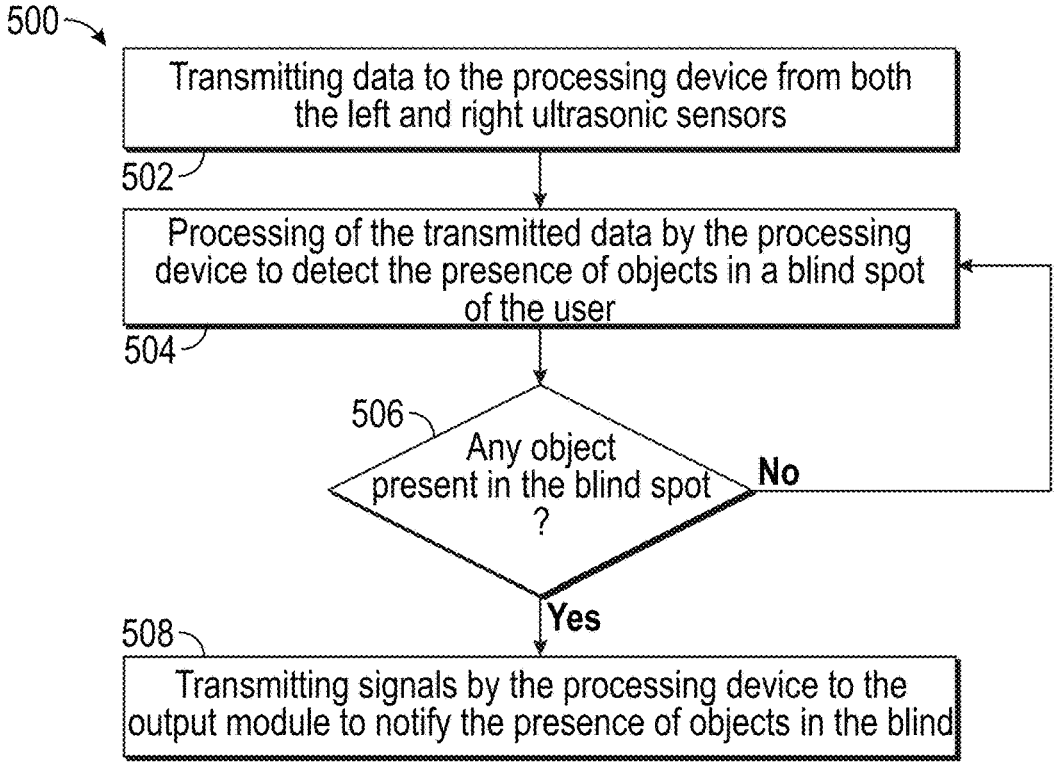
FIG. 5 is a flowchart depicting a method for identification and notification of presence of objects in the blind spot of a user by means of a helmet system 500, in accordance with a non-limiting exemplary embodiment of the present disclosure.

Referring to FIG. 5, it is a flowchart depicting a method for identification and notification of presence of objects in the blind spot of a user by means of a helmet system 500, in accordance with a non-limiting exemplary embodiment of the present disclosure. The method begins with a step 502 of transmitting data to the processing device from both the left and right ultrasonic sensors. The next step 504 is processing of the transmitted data by the processing device to detect the presence of objects in a blind spot of the user. The step 506 validates the presence of objects in the blind spot. If objects are present in the blind spot, then the method proceeds to step 508 of transmitting signals by the processing device to the LED output module to notify the presence of objects in the blind spot. If there are no objects in the blind spot, then the step 506 goes back to the first step 502 with the sensors transmitting fresh data to the processing device.

Figure 6A:
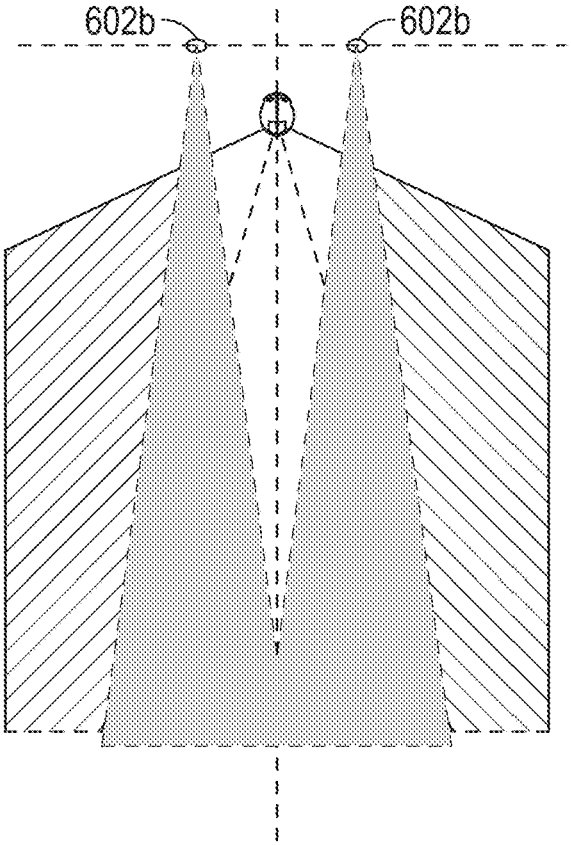
FIG. 6 (*a*) is a diagrammatic representation showing the average blind spot region for motorcyclists.
Figure 6B:
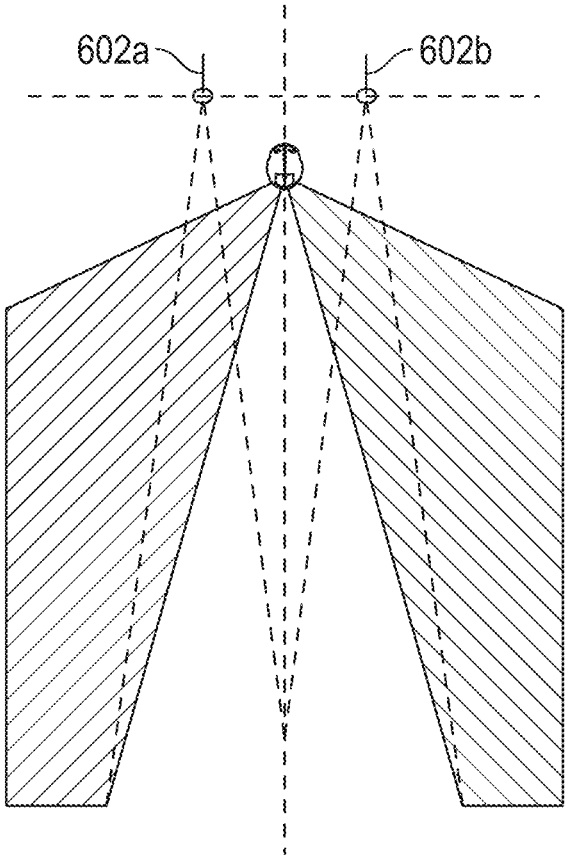

Referring to FIG. 6 (*a*), it is a diagrammatic representation showing the average blind spot region for motorcyclists, wherein the gray shaded region shows the range of the rear view mirrors 602*a*-602*b* and the hatched region shows the blind spot of the user. Referring to FIG. 6 (*b*), it is a diagrammatic representation showing the region covered by the helmet system in accordance with a non-limiting exemplary embodiment of the present disclosure. The hatched region shows the region including blind spot area covered by the helmet system for identifying and notifying the presence of objects.

In different embodiments, the helmet systems are integrated with artificial intelligence (AI), wherein the AI integrated helmet systems can detect various situations and react/adapt accordingly in an intelligent manner.

In different embodiments, the helmet systems are configured to collect the traffic data while riding and correlate and compute it with the map application in computing devices such as mobile phones to provide real time traffic data for navigation purposes.

Although the present disclosure has been described in terms of certain preferred embodiments and illustrations thereof, other embodiments and modifications to preferred embodiments may be possible that are within the principles and spirit of the invention. The above descriptions and figures are therefore to be regarded as illustrative and not restrictive.

Thus the scope of the present disclosure is defined by the appended claims and includes both combinations and sub combinations of the various features described herein above as well as variations and modifications thereof, which would occur to persons skilled in the art upon reading the foregoing description.

I claim:

1. A helmet system, comprising:

at least one helmet body;

at least two ultrasonic sensors positioned at the left and right side of at least one helmet body to cover a blind spot on the left and right side of a user;

at least two LED output modules positioned at the right and left side of the front of at least one helmet body;

at least two vibration motors which are concealed on either side of the helmet body and at least two vibration motors configured to generate the different patterns of a haptic feedback based on the different signals generated by at least two ultrasonic sensors;

at least two speakers are positioned at the right and left side of at least one helmet body and at least two speakers are configured to give an audio feedback;

and at least one processing device electrically coupled to at least two ultrasonic sensors, at least two LED output modules, at least two vibration motors and at least two speakers, whereby at least two ultrasonic sensors configured to detect objects in the blind spot region and at least one LED output module and at least one vibration motor and at least one speaker configured to notify the presence of the objects.

2. The helmet system of claim 1, wherein at least two ultrasonic sensors configured to transmit the detected data to at least one processing device.

3. The helmet system of claim 1, comprising at least one communication module electrically coupled to at least processing device and at least one communication module configured to establish communication with at least one end user device.

4. The helmet system of claim 1, comprising at least one speaker and at least one microphone are positioned at the side of the helmet body which enables the user to utilize the facility for receiving or making phone calls and other auditory purpose.

5. The helmet system of claim 1, comprising at least one left ultrasonic sensor and at least one right ultrasonic sensor are electrically coupled to at least one processing device.

6. The helmet system of claim 5, wherein at least one left ultrasonic sensor and at least one right ultrasonic sensor are configured to emit sound waves and detect objects in a blind spot region.

7. The helmet system of claim 5, wherein at least one left ultrasonic sensor and at least one right ultrasonic sensor are configured to transmit the detected data to at least one processing device.

* * * * *